US009098004B2

(12) United States Patent
Yamada et al.

(10) Patent No.: US 9,098,004 B2
(45) Date of Patent: Aug. 4, 2015

(54) LIQUID DEVELOPER

(71) Applicant: Kao Corporation, Chuo-ku (JP)

(72) Inventors: Tatsuya Yamada, Wakayama (JP); Shingo Takada, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 14/135,987

(22) Filed: Dec. 20, 2013

(65) Prior Publication Data

US 2014/0186763 A1 Jul. 3, 2014

(51) Int. Cl.

| | |
|---|---|
| ***G03G 9/00*** | (2006.01) |
| ***G03G 9/135*** | (2006.01) |
| ***G03G 9/125*** | (2006.01) |

(52) U.S. Cl.

CPC ..... *G03G 9/135* (2013.01); *G03G 9/125* (2013.01)

(58) Field of Classification Search

CPC ..... G03G 9/125
USPC ..... 430/116
See application file for complete search history.

(56) References Cited

U.S. PATENT DOCUMENTS

| | | | | |
|---|---|---|---|---|
| 4,631,244 | A * | 12/1986 | Mitchell | 430/137.19 |
| 5,364,726 | A | 11/1994 | Morrison et al. | |
| 5,525,449 | A * | 6/1996 | Spiewak et al. | 430/115 |
| 2004/0259015 | A1 | 12/2004 | Tsubuko et al. | |
| 2012/0251939 | A1 | 10/2012 | Tani et al. | |
| 2014/0004458 | A1 | 1/2014 | Tani et al. | |

FOREIGN PATENT DOCUMENTS

| | | | |
|---|---|---|---|
| EP | 0 069 827 | A2 | 1/1983 |
| EP | 0 455 343 | A1 | 11/1991 |
| JP | 6-236078 | A | 8/1994 |
| JP | 2005-10528 | A | 1/2005 |
| JP | 2009-157254 | A | 7/2009 |
| JP | 2013-190657 | A | 9/2013 |
| JP | 2014-10164 | A | 1/2014 |
| WO | WO 2012/124791 | A1 | 9/2012 |

OTHER PUBLICATIONS

U.S. Appl. No. 14/140,915, filed Dec. 26, 2013, Yamada, et al.

* cited by examiner

*Primary Examiner* — Mark A Chapman
(74) *Attorney, Agent, or Firm* — Oblon, McClelland, Maier & Neustadt, L.L.P.

(57) ABSTRACT

A liquid developer containing toner particles containing a resin and a pigment, and an insulating liquid, the toner particles being dispersed in the insulating liquid, wherein the insulating liquid contains an olefin having 12 carbon atoms or more and 18 carbon atoms or less in an amount of 10% by mass or more. The liquid developer of the present invention can be suitably used in developing latent images formed in, for example, an electrophotographic method, an electrostatic recording method, an electrostatic printing method, or the like.

19 Claims, No Drawings

LIQUID DEVELOPER

FIELD OF THE INVENTION

The present invention relates to a liquid developer, usable in developing latent images formed in, for example, an electrophotographic method, an electrostatic recording method, an electrostatic printing method, or the like.

BACKGROUND OF THE INVENTION

Electrophotographic developers are a dry developer in which toner components containing materials containing a colorant and a resin binder are used in a dry state, and a liquid developer in which toner components are dispersed in an insulating carrier liquid.

Liquid developers allow the toner particles to form into smaller particles, so that they give excellent image quality, thereby making it suitable for commercial printing applications. In addition, in the recent years, with the increasing demands for speeding up, liquid developers with lowered viscosities are also in demand. In other words, liquid developers in which toner particles are stably dispersed at smaller particle sizes and lower viscosities are in demand.

In addition, in the recent years, with increased awareness in environmental protection, an insulating liquid having a low volatility is being used as a disperse medium for liquid developers.

Patent Document 1 (Japanese Patent Laid-Open No. 2009-157254) discloses a liquid developer characterized in that the liquid developer contains an insulating hydrocarbon organic solvent 2-octyl-1-dodecene and/or 2-octyldodecane; colored resin particles comprising at least two components of a pigment and a resin binder undissolvable in the above solvent; a dispersant dissolvable in the above solvent; and a charge control agent, wherein a total content of the above solvent is 70% by mass or more of the entire amount 100% by mass of the insulating hydrocarbon organic solvent, for the purpose of lowering viscosity of the system and improving electrophoretic property while considering environmental issues.

Patent Document 2 (Japanese Patent Laid-Open No. Hei-6-236078, corresponding to U.S. Pat. No. 5,364,726) discloses a liquid developer containing a colorant and a substantial amount of a curable liquid vehicle having a viscosity of not greater than about 500 centi-Poise, and a resistivity of not less than about $10^8$ ohm-cm, as a liquid developer composition having an advantage of reducing the generation of a solvent steam from a liquid development apparatus and from the printouts produced by the liquid developer.

Patent Document 3 (Japanese Patent Laid-Open No. 2005-10528, corresponding to U.S. Patent Application Publication No. 2004/0259015) discloses that high-quality images, such as ID, blurriness, and coloration, in an electrophotographic liquid developer are achieved, and the generation of a solvent steam, an odor from an insulating liquid or the like is suppressed or reduced, thereby excellent dispersibility of the colorant, high optical density, stable high-resolution, and high-chromatic fused images are obtained, and that as a liquid toner which is capable of suppressing the generation of a solvent steam during fusing and thus suitable for a process of fusing concurrently with transferring, a recording material in which a colorant is dispersed in a non-aqueous dispersion medium, characterized in that the non-aqueous dispersion medium contains at least a poly-alpha olefin.

SUMMARY OF THE INVENTION

The present invention relates to a liquid developer containing toner particles containing a resin and a pigment, and an insulating liquid, the toner particles being dispersed in the insulating liquid, wherein the insulating liquid contains an olefin having 12 carbon atoms or more and 18 carbon atoms or less in an amount of 10% by mass or more.

DETAILED DESCRIPTION OF THE INVENTION

According to conventional techniques, when an insulating liquid having a low volatility is used, it is difficult to obtain a liquid developer showing high fusing ability while retaining dispersion stability, i.e. storage stability.

The present invention relates to a liquid developer having excellent dispersion stability and fusing ability, even when an insulating liquid having a low volatility is used.

The liquid developer of the present invention has excellent dispersion stability and fusing ability of the toner particles, even when an insulating liquid having a low volatility is used.

The liquid developer of the present invention is a liquid developer containing toner particles containing a resin and a pigment, and an insulating liquid, wherein the toner particles are dispersed in the insulating liquid, which has a feature that the insulating liquid contains an olefin having from 12 to 18 carbon atoms in a particular amount, and the liquid developer has excellent dispersion stability and fusing ability, even when an insulating liquid having a low volatility is used.

The reasons why such effects are exhibited are not elucidated, and they are considered to be as follows.

An olefin includes a double bond, so that its polarity is higher than a saturated hydrocarbon, and that its affinity with a resin is high. Therefore, since the olefin is contained in a particular amount, the resin is more likely to be plasticized or swollen when heated to high temperatures during fusing, thereby improving fusing ability. On the other hand, since the olefin having from 12 to 18 carbon atoms is used, it is considered that the resulting liquid keeps an appropriate viscosity, that it is free from the disadvantage of generating dispersion medium steam upon use, and that the solidification can be avoided, and at the same time penetration of the olefin in the resin in the dispersion is suppressed, thereby improving storage stability.

[Resin]

The resin in the liquid developer of the present invention is a resin that serves as a resin binder of toner particles, and the resin includes, for example, styrenic resins which are homopolymers or copolymers containing styrene or substituted styrenes, such as polystyrenes, styrene-propylene copolymers, styrene-butadiene copolymers, styrene-vinyl chloride copolymers, styrene-vinyl acetate copolymers, styrene-maleic acid copolymers, styrene-acrylate copolymers, and styrene-methacrylate copolymers; polyesters, epoxy resins, rosin-modified maleic acid resins, polyethylene resins, polypropylene, polyurethane, silicone resins, phenolic resins, and aliphatic or alicyclic hydrocarbon resins, and one or more kinds of these resins can be used in combination.

Among the above resins, the polyesters and styrene-acrylate copolymers are preferred, and more preferably polyesters, from the viewpoint of improving fusing ability of the liquid developer. The content of the polyester is preferably 90% by mass or more of the resin, more preferably 95% by mass or more, even more preferably substantially 100% by mass, and even more preferably 100% by mass, i.e. only the polyester is used as the resin.

In the present invention, it is preferable that the polyester is obtained by polycondensing an alcohol component containing a dihydric or higher polyhydric alcohol, and a carboxylic acid component containing a dicarboxylic or higher polycarboxylic acid compound.

The dihydric alcohol includes diols having from 2 to 20 carbon atoms, and preferably from 2 to 15 carbon atoms; and an alkylene oxide adduct of bisphenol A represented by the formula (I):

(I)

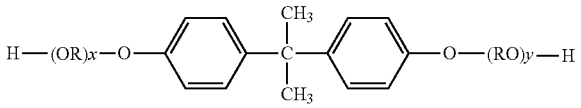

wherein RO and OR are an oxyalkylene group, wherein R is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4;

and the like. Specific examples of the dihydric alcohol having from 2 to 20 carbon atoms include ethylene glycol, 1,2-propanediol, 1,3-propanediol, 1,4-butanediol, 1,6-hexanediol, bisphenol A, hydrogenated bisphenol A, and the like.

The alcohol component is preferably 1,2-propanediol and the alkylene oxide adduct of bisphenol A represented by the formula (I), and more preferably the alkylene oxide adduct of bisphenol A represented by the formula (I), from the viewpoint of improving fusing ability of the liquid developer, and from the viewpoint of improving dispersion stability of toner particles in the liquid developer, thereby improving storage stability. The content of the alkylene oxide adduct of bisphenol A represented by the formula (I) is preferably 50% by mol or more, more preferably 70% by mol or more, even more preferably 90% by mol or more, even more preferably substantially 100% by mol, and even more preferably 100% by mol, of the alcohol component.

The trihydric or higher polyhydric alcohol includes trihydric or higher polyhydric alcohols having from 3 to 20 carbon atoms, and preferably from 3 to 10 carbon atoms. Specific examples thereof include sorbitol, 1,4-sorbitan, pentaerythritol, glycerol, trimethylolpropane, and the like.

The dicarboxylic acid compound includes, for example, dicarboxylic acids having from 3 to 30 carbon atoms, preferably from 3 to 20 carbon atoms, and more preferably from 3 to 10 carbon atoms, and derivatives thereof such as acid anhydrides thereof, alkyl esters thereof in which alkyl group has from 1 to 3 carbon atoms, and the like. Specific examples include aromatic dicarboxylic acid such as phthalic acid, isophthalic acid, and terephthalic acid; and aliphatic dicarboxylic acid such as fumaric acid, maleic acid, succinic acid, glutaric acid, adipic acid, sebacic acid, succinic acid substituted with an alkyl group having from 1 to 20 carbon atoms or an alkenyl group having from 2 to 20 carbon atoms.

The tricarboxylic or higher polycarboxylic acid compound includes, for example, tricarboxylic or higher polycarboxylic acids having from 4 to 30 carbon atoms, preferably from 6 to 20 carbon atoms, and more preferably from 9 to 10 carbon atoms, derivatives thereof, such as acid anhydrides thereof and alkyl esters thereof in which alkyl group has from 1 to 3 carbon atoms, and the like. Specific examples include 1,2,4-benzenetricarboxylic acid, i.e. trimellitic acid, 1,2,4,5-benzenetetracarboxylic acid, i.e. pyromellitic acid, and the like.

The carboxylic acid component is preferably terephthalic acid, fumaric acid, and trimellitic anhydride, and more preferably terephthalic acid, from the viewpoint of improving fusing ability of the liquid developer.

Also, the alcohol component may properly contain a monohydric alcohol, and the carboxylic acid component may properly contain a monocarboxylic acid compound, from the viewpoint of adjusting the softening point of the polyester.

An equivalent ratio of the carboxylic acid component and the alcohol component in the polyester, i.e. COOH group or groups/OH group or groups, is preferably from 0.70 to 1.10, and more preferably from 0.75 to 1.00, from the viewpoint of adjusting the softening point of the polyester.

The polyester can be produced by polycondensing the alcohol component and the carboxylic acid component in an inert gas atmosphere at a temperature of from 180° to 250° C. or so, optionally in the presence of an esterification catalyst, an esterification promoter, a polymerization inhibitor or the like.

The esterification catalyst includes tin compounds such as dibutyltin oxide and tin(II) 2-ethylhexanoate; titanium compounds such as titanium diisopropylate bistriethanolaminate; and the like. The esterification promoter includes gallic acid, and the like. In addition, the amount of the esterification catalyst used is preferably from 0.01 to 1.5 parts by mass, and more preferably from 0.1 to 1.0 part by mass, based on 100 parts by mass of a total amount of the alcohol component and the carboxylic acid component. The amount of the esterification promoter used is preferably from 0.001 to 0.5 parts by mass, and more preferably from 0.01 to 0.1 parts by mass, based on 100 parts by mass of a total amount of the alcohol component and the carboxylic acid component. The polymerization inhibitor includes tert-butyl catechol and the like. The amount of the polymerization inhibitor used is preferably from 0.001 to 0.5 parts by mass, and more preferably from 0.01 to 0.1 parts by mass, based on 100 parts by mass of a total amount of the alcohol component and the carboxylic acid component.

The polyester has a softening point of preferably 160° C. or lower, more preferably 130° C. or lower, even more preferably 120° C. or lower, and even more preferably 100° C. or lower, from the viewpoint of improving fusing ability of the liquid developer. In addition, the polyester has a softening point of preferably 70° C. or higher, and more preferably 75° C. or higher, from the viewpoint of improving dispersion stability of the liquid developer, thereby improving storage stability.

The polyester has a glass transition temperature of preferably 80° C. or lower, more preferably 70° C. or lower, and even more preferably 60° C. or lower, from the viewpoint of improving fusing ability of the liquid developer. Also, the polyester has a glass transition temperature of preferably 40° C. or higher, and more preferably 45° C. or higher, from the viewpoint of improving dispersion stability of the liquid developer, thereby improving storage stability.

The polyester has an acid value of preferably 110 mgKOH/g or less, more preferably 70 mgKOH/g or less, even more preferably 50 mgKOH/g or less, and even more preferably 30 mgKOH/g or less, from the viewpoint of reducing viscosity of the liquid developer, and from the viewpoint of improving dispersion stability of toner particles in the liquid developer, thereby improving storage stability. In addition, the polyester has an acid value of preferably 3 mgKOH/g or more, more preferably 5 mgKOH/g or more, and even more preferably 8 mgKOH/g or more, from the same viewpoint. The acid value of the polyester can be adjusted by a method including varying an equivalent ratio of the carboxylic acid component and the alcohol component, varying a reaction time during the resin production, varying a content of the tricarboxylic or higher polycarboxylic acid compound, or the like.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in Japanese Patent Laid-Open No. Hei-11-133668, Hei-10-239903, Hei-8-20636, or the like.

[Pigment]

As the pigment, all of the pigments which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. In the present invention, the toner particles may be any of black toners and color toners.

The content of the pigment is preferably 100 parts by mass or less, more preferably 70 parts by mass or less, even more preferably 50 parts by mass or less, and even more preferably 25 parts by mass or less, based on 100 parts by mass of the resin, from the viewpoint of improving fusing ability of the liquid developer. In addition, the content of the pigment is preferably 5 parts by mass or more, more preferably 10 parts by mass or more, and even more preferably 15 parts by mass or more, based on 100 parts by mass of the resin, from the viewpoint of improving optical density of the liquid developer.

In the present invention, an additive such as a releasing agent, a charge control agent, a charge control resin, a magnetic particulate, a fluidity improver, an electric conductivity modifier, a reinforcing filler such as a fibrous material, an antioxidant, or a cleanability improver may be further properly used as a toner material.

[Method for Producing Toner Particles]

The method for obtaining toner particles includes a method including melt-kneading toner raw materials containing a resin and a pigment, and pulverizing the melt-kneaded mixture obtained to provide toner particles; a method including mixing an aqueous resin dispersion and an aqueous pigment dispersion, thereby unifying the resin particles and the pigment particles; and a method including stirring an aqueous resin dispersion and a pigment at high speed; and the like. The method including melt-kneading toner raw materials, and pulverizing the melt-kneaded mixture obtained is preferred, from the viewpoint of improving developing ability and fusing ability of the liquid developer.

The melt-kneading of toner raw materials can be carried out with a known kneader, such as a closed kneader, a single-screw or twin-screw kneader, or an open-roller type kneader. In the method for producing a liquid developer of the present invention, it is preferable to use an open-roller type kneader, from the viewpoint of improving dispersibility of the pigment in the resin, and from the viewpoint of improving an yield of the toner particles after pulverization.

It is preferable that the toner raw materials containing a resin and a pigment are previously mixed with a mixer such as a Henschel mixer, a Super mixer or a ball-mill, and thereafter fed to a kneader. Among these mixers, Henschel mixer is preferred, from the viewpoint of improving dispersibility of the pigment in the resin.

The mixing of the toner raw materials with a Henschel mixer is carried out by adjusting a peripheral speed of agitation, and a mixing time. The peripheral speed of agitation is preferably from 10 to 30 m/sec, from the viewpoint of improving dispersibility of the pigment in the resin. In addition, the agitation time is preferably from 1 to 10 minutes, from the viewpoint of improving dispersibility of the pigment in the resin.

The open-roller type kneader refers to a kneader of which kneading unit is an open type, not being tightly closed, and the kneading heat generated during the melt-kneading can be easily dissipated. The open-roller type kneader used in the present invention is provided with a plurality of feeding ports for raw materials and a discharging port for a kneaded mixture along the shaft direction of the roller, and it is preferable that the open roller-kneader is a continuous open roller-type kneader, from the viewpoint of production efficiency.

It is preferable that the open-roller type kneader used in the present invention is provided with at least two kneading rollers having different temperatures. The temperature of the rollers can be adjusted by, for example, a temperature of a heating medium passing through the inner portion of the rollers, and each of the rollers may be divided in two or more portions in the inner portion of the rollers, the rollers being passed through with heating media of different temperatures.

In the present invention, it is preferable that in both of the rollers, the temperature of the discharge port for a kneaded mixture of the kneader is set at a temperature lower than the temperature which is 10° C. higher than softening point of the resin, from the viewpoint of improving miscibility of the toner raw materials.

It is preferable that the set temperature of the upstream side of kneading and the set temperature of the downstream side of kneading in the heat roller are such that the set temperature of the upstream side is higher than that of the downstream side, from the viewpoint of making the adhesiveness of the kneaded mixture to the roller at an upstream side favorable and strongly kneading at a downstream side.

In the roller of which set temperature at an upstream side of kneading is lower, which is also referred to as a cooling roller, the set temperature at an upstream side of kneading may be the same as or different from the set temperature of the downstream side of kneading.

The rollers of the open roller-type kneader are preferably those having peripheral speeds that are different from each other. In the open roller-type kneader provided with the heat roller and the cooling roller mentioned above, it is preferable that the heat roller is a roller having a higher peripheral speed, i.e. a high-rotation roller, and that the cooling roller is a roller having a lower peripheral speed, i.e. a low-rotation roller, from the viewpoint of improving fusing ability of the liquid developer.

The peripheral speed of the high-rotation roller is preferably from 2 to 100 m/min, and more preferably from 5 to 75 m/min. The peripheral speed of the low-rotation roller is preferably from 2 to 100 m/min, more preferably from 4 to 60 m/min, and even more preferably from 4 to 50 m/min. In addition, the ratio of the peripheral speeds of the two rollers, i.e. low-rotation roller/high-rotation roller, is preferably from 1/10 to 9/10, and more preferably from 3/10 to 8/10.

The gap between the two rollers, i.e. clearance, at an end part on the upstream side of the kneading is preferably from 0.1 to 3 mm, and more preferably from 0.1 to 1 mm.

Structures, size, materials and the like of each the rollers are not particularly limited. The surface of the roller contains a groove used in kneading, and the shapes of grooves include linear, spiral, wavy, rugged or other forms.

The feeding rates and the average residence time of the raw material mixture differ depending upon the size of the rollers used, components of the raw materials, and the like, so that optimal conditions among these conditions may be selected.

The kneaded mixture obtained by melt-kneading the components with an open roller-type kneader is cooled to an extent that is pulverizable, and subjecting the obtained mixture to ordinary processes such as a pulverizing step and optionally a classifying step, whereby the toner particles of the present invention can be obtained.

The pulverizing step may be carried out in divided multistages. For example, the melt-kneaded mixture may be roughly pulverized to a size of from 1 to 5 mm or so, and the roughly pulverized product may then be further finely pulverized. In addition, in order to improve productivity during the pulverizing step, the melt-kneaded mixture may be mixed with fine inorganic particles made of hydrophobic silica or the like, and then pulverized.

The pulverizer usable in the pulverizing step is not particularly limited. For example, the pulverizer suitably used in the rough pulverization includes an atomizer, Rotoplex, and the like, or a hammer-mill or the like may be used. The pulverizer suitably used in the fine pulverization includes a fluidised bed opposed jet mill, an air jet mill, a rotary mechanical mill, and the like.

The above pulverized product may be classified with a classifier as occasion demands. The classifier used in the classification step includes an air classifier, a rotor type classifier, a sieve classifier, and the like. The pulverized product which is insufficiently pulverized and removed during the classifying step may be subjected to the pulverizing step again, and the pulverizing step and the classifying step may be repeated as occasion demands.

The toner particles obtained in the above pulverizing step and an optional classifying step have a volume-median particle size $D_{50}$ of preferably from 3 to 15 μm, and more preferably from 4 to 12 μm, from the viewpoint of improving productivity of the wet-milling step described later. The volume-median particle size $D_{50}$ as used herein means a particle size of which cumulative volume frequency calculated on a volume percentage is 50% counted from the smaller particle sizes.

[Method for Producing Liquid Developer]

The toner particles are dispersed in an insulating liquid in the presence of a dispersant to provide a liquid developer. It is preferable that a liquid developer is obtained by dispersing toner particles in an insulating liquid, and thereafter subjecting the toner particles to wet-milling, from the viewpoint of making particle sizes of toner particles smaller in a liquid developer, and from the viewpoint of reducing viscosity of the liquid developer.

[Insulating Liquid]

The insulating liquid has a viscosity at 25° C. of preferably 1 mPa·s or more, more preferably 2 mPa·s or more, and even more preferably 3 mPa·s or more, from the viewpoint of improving fusing ability of a liquid developer, and from the viewpoint of improving dispersion stability of the toner particles in a liquid developer, thereby improving storage stability. In addition, the insulating liquid has a viscosity at 25° C. of preferably 55 mPa·s or less, more preferably 40 mPa·s or less, even more preferably 30 mPa·s or less, even more preferably 15 mPa·s or less, and even more preferably 4 mPa·s or less, from the viewpoint of improving fusing ability and storage stability of the liquid developer. When two or more kinds of insulating liquids are used in combination, the combined insulating liquid mixture may have a viscosity within the range defined above. Here, the viscosity of the insulating liquid at 25° C. is measured in accordance with a method described in Examples set forth below.

The insulating liquid means a liquid through which electricity is less like to flow, and in the present invention, a liquid having a dielectric constant of 3.5 or less and a volume resistivity of $10^7$ Ωcm or more is preferred.

The insulating liquid in the liquid developer of the present invention contains an olefin having 12 carbon atoms or more and 18 carbon atoms or less (hereinafter also simply referred to as the olefin).

The olefin refers to a hydrocarbon compound that has one or more carbon-carbon double bonds in the molecule. The number of double bonds in one molecule is preferably 3 or less, more preferably 2 or less, and even more preferably 1.

The number of carbon atoms of the olefin is 12 or more, preferably 14 or more, and more preferably 16 or more, from the viewpoint of improving fusing ability of the liquid developer, from the viewpoint of improving dispersion stability of the toner particles in a liquid developer, thereby improving storage stability, and from the viewpoint of suppressing the generation of the dispersion medium steam, and the number is preferably an even number, from the viewpoint of economic advantages. In addition, the number of carbon atoms of the olefin is 18 or less, preferably 16 or less, and more preferably 14 or less, from the viewpoint of reducing a viscosity of the liquid developer. Also, the preferred range of the number of carbon atoms of the olefin is preferably from 14 to 18, more preferably from 16 to 18, even more preferably 16 and 18, and even more preferably 18.

The structure of the molecular chain of the olefin may be a linear olefin or a branched olefin, and the linear olefin is preferred, from the viewpoint of reducing a viscosity of the liquid developer.

Specific examples of the linear olefins having 12 carbon atoms or more and 18 carbon atoms or less having one double bond include dodecene (number of carbon atoms: 12), tridecene (number of carbon atoms: 13), tetradecene (number of carbon atoms: 14), pentadecene (number of carbon atoms: 15), hexadecene (number of carbon atoms: 16), heptadecene (number of carbon atoms: 17), octadecene (number of carbon atoms: 18), and the like. Among them, tetradecene, pentadecene, hexadecene, heptadecene, and octadecene are preferred, from the viewpoint of improving fusing ability of the liquid developer, from the viewpoint of improving dispersion stability of the toner particles in a liquid developer, thereby improving storage stability, and from the viewpoint of suppressing the generation of a dispersion medium steam, and hexadecene and octadecene are more preferred, from the viewpoint of economic advantages. One or more of these linear olefins can be used in combination.

The olefins include, depending upon the positions of the double bonds, an α-olefin in which 85% or more of double bonds exist at a 1-position of the carbon chain, and an internal olefin in which less than 3% of double bonds exist at a 1-position of the carbon chain. The internal olefin is preferred, from the viewpoint of improving dispersion stability of the toner particles in a liquid developer, thereby improving storage stability, and from the viewpoint of improving fusing ability.

The position of the double bond in the internal olefin can be confirmed by, for example, gas chromatography mass spectrometer (GC-MS). Specifically, by accurately separating each component that has different chain lengths and double bond positions with a gas chromatography spectrometer (GC), the proportions of each of the olefins can be calculated from the GC peak areas. Further, the positions of the double bonds in the olefin can be identified with a mass spectrometer (MS).

The content of the olefin is 10% by mass or more, preferably 20% by mass or more, more preferably 40% by mass or more, even more preferably 60% by mass or more, even more preferably 80% by mass or more, even more preferably 90% by mass or more, even more preferably substantially 100% by mass, and even more preferably 100% by mass, of the insulating liquid, from the viewpoint of improving fusing ability of the liquid developer, and from the viewpoint of improving dispersion stability of the toner particles in a liquid developer, thereby improving storage stability.

Specific examples of the insulating liquid other than the olefin include, for example, aliphatic hydrocarbons, alicyclic hydrocarbons, aromatic hydrocarbons, halogenated hydrocarbons, polysiloxanes, vegetable oils, and the like. Among them, the aliphatic hydrocarbons such as liquid paraffin and isoparaffin are preferred, from the viewpoint of reducing a viscosity of the liquid developer, and from the viewpoint of odor, harmlessness, and costs, and vegetable oils are preferred, from the viewpoint of eco-friendliness .

Commercially available products of the aliphatic hydrocarbons include Isopar G, Isopar H, Isopar L, Isopar K, hereinabove commercially available from Exxon Mobile Corporation; ShellSol 71 commercially available from Shell Chemicals Japan Ltd; IP Solvent 1620, IP Solvent 2080, hereinabove commercially available from Idemitsu Kosan Co., Ltd.; MORESCO WHITE P-55, MORESCO WHITE P-70, MORESCO WHITE P-100, MORESCO WHITE P-150, MORESCO WHITE P-260, hereinabove commercially available from MORESCO Corporation; Cosmo White P-60, Cosmo White P-70, hereinabove commercially available from COSMO OIL LUBRICANTS, CO., LTD.; Lytol commercially available from Sonneborn; and the like. Among them, one of them or two or more in combination can be used.

Specific examples of the vegetable oils include rapeseed oil, safflower oil, sunflower oil, sesame oil, soybean oil, palm oil, palm kernel oil, coconut oil, and the like. Among them, rapeseed oil and safflower oil are preferred, from the viewpoint of reducing a viscosity of the liquid developer, and from the viewpoint of maintaining a high volume resistivity.

When the insulating liquid other than olefin is used, the mass ratio of the olefin to the insulating liquid other than the olefin, i.e. the olefin/the insulating liquid other than the olefin, is preferably from 10/90 to 90/10, more preferably from 10/90 to 70/30, and even more preferably from 15/85 to 60/40, from the viewpoint of improving fusing ability of the liquid developer, and from the viewpoint of improving dispersion stability of the toner particles in a liquid developer, thereby improving storage stability.

[Dispersant]

A dispersant is used for the purpose of stably dispersing toner particles in an insulating liquid, and in the present invention, a basic dispersant having a basic adsorbing group as an adsorbing group is preferred, from the viewpoint of improving adsorbability of the resin, particularly a polyester.

The basic dispersant is preferably one having a structure in which a basic adsorbing group and a dispersing group are present in the same molecule, and more preferably one having a structure in which a basic adsorbing group is present as a main chain, and a dispersing group is present as a side chain. The basic adsorbing group includes an amino group, an amide group, an imino group, a pyrrolidone group, a pyridine group, and the like, and an amino group, an amide group, and an imino group are preferred, from the viewpoint of improving dispersion stability of the toner particles in a liquid developer, thereby improving storage stability. The dispersing group is preferably a group which is compatible with an insulating liquid, and specifically one having a hydrocarbon chain or a hydroxy-hydrocarbon chain is more preferred. Among the basic dispersants mentioned above, a condensate formed between a polyimine and a carboxylic acid is preferred, from the viewpoint of improving dispersion stability of the toner particles in a liquid developer, thereby improving storage stability.

The polyimine includes polyethyleneimine, polypropyleneimine, polybutyleneimine, and the like. The polyethyleneimine is preferred, from the viewpoint of improving dispersion stability of the toner particles in a liquid developer, thereby improving storage stability.

The carboxylic acid is preferably a carboxylic acid having 10 to 30 carbon atoms, more preferably a carboxylic acid having 12 to 24 carbon atoms, and even more preferably a carboxylic acid having 16 to 22 carbon atoms, from the viewpoint of improving dispersion stability of the toner particles in a liquid developer, thereby improving storage stability. In addition, the saturated or unsaturated aliphatic carboxylic acid is preferred, and a linear, saturated or unsaturated aliphatic carboxylic acid is more preferred. In addition, the carboxylic acid may have a substituent such as a hydroxy group. Specific examples of the carboxylic acid includes linear saturated aliphatic carboxylic acids such as lauric acid, myristic acid, palmitic acid, and stearic acid; linear unsaturated aliphatic unsaturated aliphatic carboxylic acids such as oleic acid, linoleic acid, and linolenic acid; hydroxycarboxylic acids such as mevalonic acid, ricinoleic acid, and 12-hydroxystearic acid, condensates thereof, and the like. Among them, the hydroxycarboxylic acids and condensates thereof are preferred, and especially 12-hydroxystearic acid and condensates thereof are more preferred, from the viewpoint of improving dispersion stability of the toner particles in a liquid developer, thereby improving storage stability.

Specific examples of the condensates formed between a polyamine and a carboxylic acid include SOLSPARSE 11200, SOLSPARSE 13940, hereinabove commercially available from Lubrizol Corporation.

The amount of the basic dispersant is, as an effective content, preferably 2 parts by mass or more, more preferably 5 parts by mass or more, and even more preferably 8 parts by mass or more, based on 100 parts by mass of the toner particles, from the viewpoint of suppressing aggregation of the toner particles, thereby reducing viscosity of a liquid developer. In addition, the amount of the basic dispersant is preferably 20 parts by mass or less, more preferably 15 parts by mass or less, and even more preferably 12 parts by mass or less, based on 100 parts by mass of the toner particles, from the viewpoint of improving developing ability and fusing ability of a liquid developer.

It is preferable that a method for mixing toner particles, an insulating liquid, and a dispersant is a method including stirring the components with an agitation mixer.

The agitation mixer is, but not particularly limited to, preferably high-speed agitation mixers, from the viewpoint of improving productivity and storage stability of the dispersion of toner particles. Specific examples are preferably DESPA commercially available from ASADA IRON WORKS CO., LTD.; T. K. HOMOGENIZING MIXER, T. K. HOMOGENIZING DISPER, T. K. ROBOMIX, hereinabove commercially available from PRIMIX Corporation; CLEARMIX commercially available from M Technique Co., Ltd; KADY Mill commercially available from KADY International, and the like.

The toner particles are previously dispersed by mixing toner particles, an insulating liquid, and a dispersant with a high-speed agitation mixer, whereby a dispersion of toner particles can be obtained, which in turn improves productivity of a liquid developer obtained in the subsequent wet-milling.

The solid content concentration of the dispersion of toner particles is preferably 20% by mass or more, more preferably 30% by mass or more, and even more preferably 35% by mass or more, from the viewpoint of improving developing ability of the liquid developer. In addition, the solid content concentration of the dispersion is preferably 50% by mass or less, more preferably 45% by mass or less, and even more preferably 40% by mass or less, from the viewpoint of improving dispersion stability of the toner particles in a liquid developer, thereby improving storage stability. Here, the solid content concentration of the dispersion of toner particles is measured in accordance with a method described in Examples set forth below.

[Wet-Milling]

The wet-milling is a method of subjecting toner particles dispersed in an insulating liquid to a mechanical milling treatment in a state that the toner particles are dispersed in an insulating liquid.

As the apparatus used in the wet-milling, for example, generally used agitation mixers such as anchor blades can be used. The agitation mixers include high-speed agitation mixers such as DESPA commercially available from ASADA IRON WORKS CO., LTD., and T. K. HOMOGENIZING MIXER commercially available from PRIMIX Corporation; pulverizers and kneaders, such as roller mills, bead mills, kneaders, and extruders; and the like. These apparatuses can be used in a plurality.

Among them, the bead mills are preferably used, from the viewpoint of making particle sizes of the toner particles in a liquid developer smaller, from the viewpoint of improving dispersibility of the toner particles in an insulating liquid, thereby improving storage stability, and from the viewpoint of reducing viscosity of the dispersion of toner particles.

By controlling particle sizes and filling ratios of media used, peripheral speed of rotors, residence time, and the like in the bead mill, toner particles having a desired particle size and a particle size distribution can be obtained.

The solid content concentration of the liquid developer is preferably 20% by mass or more, more preferably 30% by mass or more, and even more preferably 35% by mass or more, from the viewpoint of improving developing ability of the liquid developer. Also, the solid content concentration of the liquid developer is preferably 50% by mass or less, more preferably 45% by mass or less, and even more preferably 40% by mass or less, from the viewpoint of improving dispersion stability of the toner particles in the liquid developer, thereby improving storage stability. Here, the solid content concentration of the liquid developer is measured in accordance with a method described in Examples set forth below. After the preparation of the dispersion of toner particles, the solid content concentration of the dispersion of toner particles would be a solid content concentration of the liquid developer unless the dispersion is subjected to such a procedure as dilution or concentration.

The toner particles in a liquid developer have a volume-median particle size $D_{50}$ of preferably 5 μm or less, more preferably 3 μm or less, and even more preferably 2.5 μm or less, from the viewpoint of making particle sizes of the toner particles in a liquid developer smaller, thereby improving image quality of the liquid developer. In addition, the toner particles in a liquid developer have a volume-median particle size $D_{50}$ of preferably 0.5 μm or more, more preferably 1.0 μm or more, and even more preferably 1.5 μm or more, from the viewpoint of reducing viscosity of a liquid developer. Here, the volume-median particle size $D_{50}$ of the toner particles in a liquid developer is measured in accordance with a method described in Examples set forth below.

The liquid developer has a viscosity at 25° C. of preferably 150 mPa·s or less, more preferably 100 mPa·s or less, even more preferably 80 mPa·s or less, even more preferably 60 mPa·s or less, even more preferably 50 mPa·s or less, even more preferably 30 mPa·s or less, even more preferably 20 mPa·s or less, and even more preferably 19 mPa·s or less, from the viewpoint of improving developing ability of a liquid developer. In addition, the liquid developer has a viscosity at 25° C. of preferably 2 mPa·s or more, more preferably 5 mPa·s or more, and even more preferably 10 mPa·s or more, from the viewpoint of improving dispersion stability of the toner particles in a liquid developer, thereby improving storage stability. Here, the viscosity of a liquid developer is measured in accordance with a method described in Examples set forth below.

With regard to the embodiments described above, the present invention further disclose the following liquid developer.

<1> A liquid developer containing toner particles containing a resin and a pigment, and an insulating liquid, wherein the toner particles are dispersed in the insulating liquid, wherein the insulating liquid contains an olefin having 12 carbon atoms or more and 18 carbon atoms or less in an amount of 10% by mass or more.

<2> The liquid developer according to the above <1>, wherein the resin contains a polyester.

<3> The liquid developer according to the above <2>, wherein the content of the polyester is preferably 90% by mass or more, more preferably 95% by mass or more, even more preferably substantially 100% by mass, and even more preferably 100% by mass, i.e. only the polyester is used as the resin, of the resin.

<4> The liquid developer according to the above <2> or <3>, wherein the polyester is preferably obtained by polycondensing an alcohol component containing a dihydric or higher polyhydric alcohol, and a carboxylic acid component containing a dicarboxylic or higher polycarboxylic acid compound.

<5> The liquid developer according to the above <4>, wherein the alcohol component contains an alkylene oxide adduct of bisphenol A represented by the formula (I).

<6> The liquid developer according to the above <5>, wherein the content of the alkylene oxide adduct of bisphenol A represented by the formula (I) is preferably 50% by mol or more, more preferably 70% by mol or more, even more preferably 90% by mol or more, even more preferably substantially 100% by mol, and even more preferably 100% by mol, of the alcohol component.

<7> The liquid developer according to any one of the above <4> to <6>, wherein the carboxylic acid component preferably contains at least one member selected from the group consisting of terephthalic acid, fumaric acid, and trimellitic anhydride, and more preferably containing terephthalic acid.

<8> The liquid developer according to any one of the above <2> to <7>, wherein the polyester has a softening point of preferably 160° C. or lower, more preferably 130° C. or lower, even more preferably 120° C. or lower, and even more preferably 100° C. or lower, and preferably 70° C. or higher, and more preferably 75° C. or higher.

<9> The liquid developer according to any one of the above <2> to <8>, wherein the polyester has a glass transition temperature of preferably 80° C. or lower, more preferably 70° C. or lower, and even more preferably 60° C. or lower, and preferably 40° C. or higher, and more preferably 45° C. or higher.

<10> The liquid developer according to any one of the above <2> to <9>, wherein the polyester has an acid value of preferably 110 mgKOH/g or less, more preferably 70 mgKOH/g or less, even more preferably 50 mgKOH/g or less, and even more preferably 30 mgKOH/g or less, and preferably 3 mgKOH/g or more, more preferably 5 mgKOH/g or more, and even more preferably 8 mgKOH/g or more.

<11> The liquid developer according to any one of the above <1> to <10>, wherein the content of the pigment is preferably 100 parts by mass or less, more preferably 70 parts by mass or less, even more preferably 50 parts by mass or less, and even more preferably 25 parts by mass or less, and preferably 5 parts by mass or more, more preferably 10 parts by mass or more, and even more preferably 15 parts by mass or more, based on 100 parts by mass of the resin.

<12> The liquid developer according to any one of the above <1> to <11>, wherein the liquid developer is obtained by dispersing toner particles in an insulating liquid in the presence of a dispersant, and thereafter subjecting the toner particles to wet-milling.

<13> The liquid developer according to any one of the above <1> to <12>, wherein the insulating liquid has a viscosity at 25° C. of preferably 1 mPa·s or more, more preferably 2 mPa·s or more, and even more preferably 3 mPa·s or more, and preferably 55 mPa·s or less, more preferably 40 mPa·s or less, even more preferably 30 mPa·s or less, even more preferably 15 mPa·s or less, and even more preferably 4 mPa═s or less.

<14> The liquid developer according to any one of the above <1> to <13>, wherein the number of double bonds in one molecule of the olefin is preferably 3 or less, more preferably 2 or less, and even more preferably 1.

<15> The liquid developer according to any one of the above <1> to <14>, wherein the number of carbon atoms of the olefin is preferably 14 or more, and more preferably 16 or more.

<16> The liquid developer according to any one of the above <1> to <14>, wherein the number of carbon atoms of the olefin is preferably 16 or less, and more preferably 14 or less.

<17> The liquid developer according to any one of the above <1> to <14>, wherein the number of carbon atoms of the olefin is preferably from 14 to 18, more preferably from 16 to 18, even more preferably 16 and 18, and even more preferably 18.

<18> The liquid developer according to any one of the above <1> to <17>, wherein the olefin is preferably a linear olefin.

<19> The liquid developer according to any one of the above <1> to <18>, wherein the olefin is a linear olefin having one double bond and having 12 carbon atoms or more and 18 carbon atoms or less.

<20> The liquid developer according to the above <19>, wherein the linear olefin having one double bond and having 12 carbon atoms or more and 18 carbon atoms or less is preferably at least one member selected from the group consisting of tetradecene, pentadecene, hexadecene, heptadecene, and octadecene, and more preferably hexadecene and/or octadecene.

<21> The liquid developer according to any one of the above <1> to <20>, wherein the olefin is preferably an internal olefin.

<22> The liquid developer according to any one of the above <1> to <21>, wherein the content of the olefin is preferably 20% by mass or more, more preferably 40% by mass or more, even more preferably 60% by mass or more, even more preferably 80% by mass or more, even more preferably 90% by mass or more, even more preferably substantially 100% by mass, and even more preferably 100% by mass, of the insulating liquid.

<23> The liquid developer according to any one of the above <1> to <22>, wherein the insulating liquid contains an insulating liquid other than the olefin.

<24> The liquid developer according to the above <23>, wherein the insulating liquid other than the olefin is preferably an aliphatic hydrocarbon.

<25> The liquid developer according to the above <23>, wherein the insulating liquid other than the olefin is preferably a vegetable oil.

<26> The liquid developer according to the above <25>, wherein the vegetable oil is preferably rapeseed oil and/or safflower oil.

<27> The liquid developer according to any one of the above <23> to <26>, wherein the mass ratio of the olefin to the insulating liquid other than the olefin, i.e. the olefin/the insulating liquid other than the olefin, is preferably from 10/90 to 90/10, more preferably from 10/90 to 70/30, and even more preferably from 15/85 to 60/40.

<28> The liquid developer according to any one of the above <12> to <27>, wherein the dispersant is preferably a basic dispersant.

<29> The liquid developer according to the above <28>, wherein the basic dispersant preferably has a structure in which a basic adsorbing group and a dispersing group are present in the same molecule, and more preferably has a structure in which a basic adsorbing group is present as a main chain, and a dispersing group is present as a side chain.

<30> The liquid developer according to the above <29>, wherein the basic adsorbing group is preferably at least one member selected from the group consisting of an amino group, an amide group, and an imino group.

<31> The liquid developer according to the above <29> or <30>, wherein the dispersing group is preferably one having a hydrocarbon chain or a hydroxy-hydrocarbon chain.

<32> The liquid developer according to any one of the above <28> to <31>, wherein the basic dispersant is preferably a condensate formed between a polyimine and a carboxylic acid.

<33> The liquid developer according to any one of the above <28> to <32>, wherein the amount of the basic dispersant is preferably 2 parts by mass or more, more preferably 5 parts by mass or more, and even more preferably 8 parts by mass or more, and preferably 20 parts by mass or less, more preferably 15 parts by mass or less, and even more preferably 12 parts by mass or less, based on 100 parts by mass of the toner particles.

<34> The liquid developer according to any one of the above <12> to <33>, wherein the solid content concentration of the dispersion of toner particles is preferably 20% by mass or more, more preferably 30% by mass or more, and even more preferably 35% by mass or more, and preferably 50% by mass or less, more preferably 45% by mass or less, and even more preferably 40% by mass or less.

<35> The liquid developer according to any one of the above <1> to <34>, wherein the solid content concentration of the liquid developer is preferably 20% by mass or more, more preferably 30% by mass or more, and even more preferably 35% by mass or more, and preferably 50% by mass or less, more preferably 45% by mass or less, and even more preferably 40% by mass or less.

<36> The liquid developer according to any one of the above <1> to <35>, wherein the toner particles in a liquid developer have a volume-median particle size $D_{50}$ of preferably 5 μm or less, more preferably 3 μm or less, and even more preferably 2.5 μm or less, and preferably 0.5 μm or more, more preferably 1.0 μm or more, and even more preferably 1.5 μm or more.

<37> The liquid developer according to any one of the above <1> to <36>, wherein the liquid developer has a viscosity at 25° C. of preferably 150 mPa·s or less, more preferably 100 mPa·s or less, even more preferably 80 mPa·s or less, even more preferably 60 mPa·s or less, even more preferably 50 mPa·s or less, even more preferably 30 mPa·s or less, even more preferably 20 mPa·s or less, and even more preferably 19 mPa·s or less, and preferably 2 mPa·s or more, more preferably 5 mPa·s or more, and even more preferably 10 mPa·s or more.

<38> A method for producing a liquid developer containing toner particles containing a resin and a pigment, and an insulating liquid, wherein the toner particles are dispersed in the insulating liquid, including:

step 1: melt-kneading the resin and the pigment, and pulverizing a melt-kneaded mixture to provide toner particles;

step 2: dispersing the toner particles obtained in the step 1 in the insulating liquid in the presence of a dispersant to provide a dispersion of toner particles; and step 3: wet-milling the dispersion of toner particles obtained in the step 2 to provide a liquid developer, wherein the insulating liquid contains an olefin having 12 carbon atoms or more and 18 carbon atoms or less in an amount of 10% by mass or more.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which half of the sample flows out, when plotting a downward movement of a plunger of a flow tester "CFT-500D", commercially available from Shimadzu Corporation, against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Glass Transition Temperature of Resin]

The glass transition temperature refers to a temperature of an intersection of the extension of the baseline of equal to or lower than the temperature of the maximum endothermic peak and the tangential line showing the maximum inclination between the kick-off of the peak and the top of the peak, wherein the endothermic peaks are measured by heating a 0.01 to 0.02 g sample weighed out in an aluminum pan to 200° C., cooling the sample from that temperature to 0° C. at a cooling rate of 10° C./min, and thereafter raising the temperature of the sample at a heating rate of 10° C./min, using a differential scanning calorimeter "DSC 210," commercially available from Seiko Instruments Inc.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Viscosities at 25° C. of Insulating Liquid and Liquid Developer]

A 6 mL glass sample vial "Vial with screw cap, No. 2," commercially available from Maruemu Corporation is charged with 4 to 5 mL of a measurement solution, and a viscosity at 25° C. is measured with a torsional oscillation type viscometer "VISCOMATE VM-10A-L," commercially available from SEKONIC CORPORATION.

[Volume-Median Particle Size of Toner Particles Before Mixing with Insulating Liquid]

Measuring Apparatus: Coulter Multisizer II, commercially available from

Beckman Coulter, Inc.

Aperture Diameter: 100 μm

Analyzing Software: Coulter Multisizer AccuComp Ver. 1.19, commercially available from Beckman Coulter, Inc.

Electrolytic solution: "Isotone II," commercially available from Beckman Coulter, Inc.

Dispersion: "EMULGEN 109P," commercially available from Kao Corporation, polyoxyethylene lauryl ether, HLB: 13.6, is dissolved in the above electrolytic solution so as to have a concentration of 5% by mass to provide a dispersion.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

[Solid Content Concentrations in Dispersion of Toner Particles and in Liquid Developer]

Ten parts by mass of a dispersion of toner particles or a liquid developer is diluted with 90 parts by mass of hexane, and the dilution is rotated with a centrifuge "H-201F," commercially available from KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and the lower layer is then dried with a vacuum dryer at 0.5 kPa, 40° C. for 8 hours. The solid content concentration is calculated according to the following formula:

$$\text{Solid Content Concentration, \% by Mass} = \frac{\text{Mass of Residues After Drying}}{\text{Mass of Dispersion of Toner Particles or Liquid Developer, 10 Parts by Mass}} \times 100$$

[Volume-Median Particle Size $D_{50}$ of Toner Particles in Liquid Developer]

A volume-median particle size $D_{50}$ is determined with a laser diffraction/scattering particle size measurement instrument "Mastersizer 2000," commercially available from Malvern Instruments, Ltd., by charging a cell for measurement with "Isopar G," commercially available from Exxon Mobile Corporation, isoparaffin, under conditions that a particle refractive index is 1.58, imaginary part being 0.1, and a dispersion medium refractive index of 1.42, at a concentration that give a scattering intensity of from 5 to 15%.

Production Example 1 of Resin

A 10-L four-necked flask equipped with a nitrogen inlet tube, a dehydration tube, a stirrer, and a thermocouple was charged with raw material monomers, an esterification catalyst, and an esterification promoter, as listed in Table 1. The contents were heated to 230° C. and subjected to a reaction until a reaction percentage reached 90%, the reaction mixture was further subjected to a reaction at 8.3 kPa, and the reaction was terminated when a softening point reached 80° C., to provide a resin A having physical properties as shown in Table 1. Here, the reaction percentage as used herein means a value calculated by: [amount of generated water in reaction (mol)/theoretical amount of generated water (mol)]×100.

Production Example 2 of Resin

A 10-L four-necked flask equipped with a nitrogen inlet tube, a dehydration tube, a stirrer, and a thermocouple was charged with raw material monomers, an esterification catalyst, and an esterification promoter, as listed in Table 1. The contents were heated to 180° C., and then heated to 210° C. for 5 hours, and subjected to a reaction until a reaction percentage reached 90%. The reaction mixture was further subjected to a reaction at 8.3 kPa, and the reaction was terminated when a softening point reached 86° C., to provide a resin B having physical properties as shown in Table 1.

TABLE 1

| | | Resin A | Resin B |
|---|---|---|---|
| Raw Material Monomers | BPA-PO[1)] | 4473 g (60) | — |
| | BPA-EO[2)] | 2769 g (40) | — |
| | 1,2-Propanediol | — | 3640 g (100) |
| | Terephthalic Acid | 2758 g (78) | 6360 g (80) |
| Esterification Catalyst | Dibutyltin Oxide | 50 g | 50 g |
| Esterification Promoter | Gallic Acid | 3 g | 5 g |
| Physical Properties of Resin | Softening Point (° C.) | 80 | 86 |
| | Glass Transition Temp. (° C.) | 50 | 47 |
| | Acid Value (mgKOH/g) | 12 | 10 |

Note)
The numerical values inside parenthesis show molar ratios when a total number of moles of the alcohol component is assumed to be 100.
1) BPA-PO: Polyoxypropylene(2.2)-2,2-bis(4-hydroxyphenyl)propane
2) BPA-EO: Polyoxyethylene(2.2)-2,2-bis(4-hydroxyphenyl)propane Production Example 3 of Resin A 5-L four-necked flask equipped with a nitrogen inlet tube, a dehydration tube, a stirrer, and a thermocouple was charged with 1567 g of xylene. The contents were heated to 130° C. A liquid mixture of raw material monomers and a polymerization initiator as listed in Table 2 was added dropwise at 130° C. while stirring over 1.5 hours. Further, the reaction mixture was kept at the same temperature for 1.5 hours, to carry out an addition polymerization reaction. Following the heating of the reaction mixture to 160° C., and subjection to a reaction for 1 hour, the reaction mixture was heated to 200° C., and kept thereat for 1 hour to remove xylene. Further, the reaction mixture was kept at 8.3 kPa to remove the remaining xylene, to provide a resin C having physical properties as shown in Table 2.

TABLE 2

| | | Resin C |
|---|---|---|
| Raw Material Monomers | Styrene | 3690 g (83) |
| | 2-Ethylhexyl Acrylate | 1260 g (16) |
| | Acrylic Acid | 50 g (1) |

TABLE 2-continued

| | | Resin C |
|---|---|---|
| Polymerization Initiator | Dibutyl Phthalate | 193 g |
| Physical Properties of Resin | Softening Point (° C.) | 95 |
| | Glass Transition Temp. (° C.) | 45 |
| | Acid Value (mgKOH/g) | 10 |

Note)
The numerical values inside parenthesis show molar ratios.

Production Example of Internal Olefin

A flask equipped with an agitator was charged with 7,000 g (25.9 mol) of 1-octadecanol "KALCOL 8098," commercially available from Kao Corporation, and 1050 g of γ-alumina, commercially available from STREM Chemicals, Inc., in a proportion of 15% by mass of the raw material alcohol, as a solid acid catalyst. With stirring, the mixture was subjected to a reaction for 13 hours at 285° C. while allowing nitrogen to flow through the system at a rate of 7,000 ml/min. The alcohol conversion rate after the termination of reaction was 100%, and a purity of the C18 internal olefin was 98.5%. The resulting crude internal olefin was transferred to a distillation flask, and distilled at 148° to 158° C. and 0.5 mmHg, to provide an internal olefin A having 18 carbon atoms having an olefin purity of 100%.

The double bond distribution of the resulting internal olefin A was as follows: 0.7% by mass at C-1 position, 16.9% by mass at C-2 position, 15.9% by mass at C-3 position, 16.0% by mass at C-4 position, 14.7% by mass at C-5 position, 11.2% by mass at C-6 position, 10.1% by mass at C-7 position, 14.5% by mass at a total of C-8 position and C-9 position. The distribution of the double bond of the olefin was measured in accordance with the following method.

[Method for Determining Double Bond Distribution of Internal Olefin]

The internal olefin is reacted with dimethyl disulfide to provide a dithiolated derivative, and each of the components having different carbon chain lengths and double bond positions is then separated by gas chromatography (GC). The existing proportions of the internal olefin are obtained from each of GC peak areas. The double bond positions are identified with a mass spectrometer (MS).

The apparatuses and the spectroscopic conditions used in the GC-MS determination are as follows.

Gas Chromatograph, GC: 6890, commercially available from Agilent

Technologies

Column: BPX-35, 25 m×0.22 mm×0.25 μm, commercially available from SGE Analytical Science Carrier Gas: He, column flow rate: 1.0 mL/min Injection Mode: Split, 100:1

Injector Temp.: 300° C.

Column Oven Temp.: Heating from 60° C. at a rate of 2° C./min, and keeping at 300° C. for 5 minutes Mass Spectrometer, MS: 5975, commercially available from Agilent Technologies Ion Source Temp.: 230° C.

Analyzer Temp.: 150° C., quadripole

Transfer Line Temp.: 300° C.

Ionization Mode: EI

Scanning Range: m/z 25 to 500

The insulating liquids used in Examples and Comparative Examples are listed in Table 3.

TABLE 3

| | Viscosity at 25° C. (mPa · s) | Chemical Name | Manufacturer and Trade Name |
|---|---|---|---|
| Liquid a | 3 | C18 α-Olefin (1-Octadecene) | LINEALENE 18, commercially available from Idemitsu Kosan Co., Ltd. |
| Liquid b | 3 | C18 Internal Olefin | Synthesized Product, Internal Olefin A |
| Liquid c | 1 | C12 α-Olefin (1-Dodecene) | LINEALENE 12, commercially available from Idemitsu Kosan Co., Ltd. |
| Liquid d | 2 | C16 α-Olefin (1-Hexadecene) | LINEALENE 16, commercially available from Idemitsu Kosan Co., Ltd. |
| Liquid e | 5 | Liquid Paraffin | Lytol, commercially available from Sonneborn |
| Liquid f | 51 | Rapeseed Oil | Ace Canola Oil, commercially available from Summit Oil Mill Co., Ltd. |
| Liquid g | 58 | Safflower Oil | High Oleic Safflower Oil, commercially available from Summit Oil Mill Co., Ltd. |

Examples 1 to 12 and Comparative Examples 1 to 5

Resin A in an amount of 85 parts by mass and 15 parts by mass of a pigment "ECB-301," commercially available from DAINICHISEIKA COLOR & CHEMICALS MFG. CO., LTD., Phthalocyanine Blue, P.B. 15:3, were previously mixed with a 20-L Henschel mixer while stirring for 3 minutes at a rotational speed of 1500 r/min (a peripheral speed of 21.6 m/sec), and the mixture was melt-kneaded under the conditions given below.

[Melt-Kneading Conditions]

A continuous twin open-roller type kneader "Kneadex," commercially available from NIPPON COKE & ENGINEERING CO., LTD., outer diameter of roller: 14 cm, effective length of roller: 55 cm) was used. The operating conditions of the continuous twin open-roller type kneader are a rotational speed of a high-rotation roller (front roller) of 75 r/min (a peripheral speed of 32.4 m/min), a rotational speed of a low-rotation roller (back roller) of 35 r/min (a peripheral speed of 15.0 m/min), and a gap between the rollers at an end of the raw material supplying side of 0.1 mm. The temperatures of the heating medium and the cooling medium inside the rollers are as follows. The high-rotation roller had a temperature at the raw material supplying side of 90° C., and a temperature at the kneaded mixture discharging side of 85° C., and the low-rotation roller has a temperature at the raw material supplying side of 35° C., and a temperature at the kneaded mixture discharging side of 35° C. In addition, the feeding rate of the raw material mixture to the above kneader was 10 kg/hour, and the average residence time in the above kneader was about 3 minutes.

The kneaded mixture obtained above was cooled with a cooling roller, and the cooled product was roughly pulverized to a size of 1 mm or so with hammer-mill, and then finely pulverized and classified with an air jet type jet mill "IDS," commercially available from Nippon Pneumatic Mfg. Co., Ltd., to provide toner particles having a volume-median particle size $D_{50}$ of 10 μm.

A 1-L polyethylene vessel was charged with 35 parts by mass of toner particles obtained, 56.25 parts by mass of an insulating liquid as listed in Table 4, and 8.75 parts by mass of a basic dispersion "SOLSPARSE 13940," commercially available from Lubrizol Corporation, effective content: 40%, and the contents were stirred with "T. K. ROBOMIX," commercially available from PRIMIX Corporation, under water-cooling at a rotational speed of 7,000 r/min for 30 minutes, to provide a dispersion of toner particles having a solid content concentration of 39% by mass.

Next, the dispersion of toner particles obtained was subjected to wet-milling with 6 vessels-type sand grinder "TSG-6," commercially available from AIMEX CO., LTD., at a rotational speed of 1,300 r/min (a peripheral speed of 4.8 m/sec) using zirconia beads having a diameter of 0.8 mm at a volume filling ratio of 60% by volume until a volume-median particle size $D_{50}$ as listed in Table 4 was obtained. The beads were filtered off, to provide a liquid developer having physical properties as shown in Table 4.

Test Example 1

Storage Stability

A 20-mL glass sample vial "Vial with screw cap, No. 5," commercially available from Maruemu Corporation, was charged with 10 g of a liquid developer, and stored in a thermostat kept at 40° C. for 24 hours. The viscosities before and after storage were measured, to evaluate storage stability from the value calculated by [viscosity after storage]/[viscosity before storage]. The results are shown in Table 4. The more the number approximates 1, the more excellent the storage stability.

Test Example 2

Fusing Ability

A liquid developer was dropped on "POD Gloss Coated Paper," commercially available from Oji Paper Co., Ltd., cut into squares of 6 cm each side, and the paper was rotated using a spin-coater "MS-A150," commercially available from Mikasa Co., Ltd., to form a thin film. The liquid developer placed on the paper was adjusted with an amount dropped, a rotational speed, and rotation time so that the liquid developer was in an amount of 0.05g ±0.003 g.

The prepared thin film was kept in a thermostat at 150° C. for one minute to allow non-contact fusing. The resulting fused images were adhered to a mending tape "Scotch Mending Tape 810," commercially available from 3M, width of 18mm, the tape was pressed with a roller so as to have a load of 500 g being applied thereto, and the tape was removed. The optical densities before and after tape removal was measured with a colorimeter "Spectroeye," commercially available from X-Rite. The fused image-printed portions were measured at 3 points each, and an average thereof was calculated as an optical density. A fusing ratio (%) was calculated from a value obtained by [optical density after removal]/[optical density before removal]×100, to evaluate fusing ability. The results are shown in Table 4. The larger the numerical values, the more excellent the fusing ability.

TABLE 4

| | Insulating Liquids* | Viscosity of Insulating Liquid (mPa · s) | Resin | $D_{50}$ (μm) of Toner Particles | Viscosity of Liquid Developer (mPa · s) Before Storage X | After Storage Y | Storage Stability [Y/X] | Fusing Ability [Fusing Ratio (%)] |
|---|---|---|---|---|---|---|---|---|
| Ex. 1 | Liquid a | 3 | Resin A | 1.8 | 19 | 20 | 1.1 | 93 |
| Ex. 2 | Liquid b | 3 | Resin A | 1.8 | 18 | 19 | 1.1 | 94 |
| Ex. 3 | Liquid c | 1 | Resin A | 1.8 | 12 | 15 | 1.3 | 90 |
| Ex. 4 | Liquid d | 2 | Resin A | 1.8 | 14 | 16 | 1.1 | 92 |
| Ex. 5 | Liquid a (20)<br>Liquid e (80) | 5 | Resin A | 1.8 | 22 | 24 | 1.1 | 90 |
| Ex. 6 | Liquid a (50)<br>Liquid e (50) | 5 | Resin A | 1.8 | 20 | 22 | 1.1 | 92 |
| Ex. 7 | Liquid a (20)<br>Liquid f (80) | 27 | Resin A | 1.9 | 65 | 70 | 1.1 | 92 |
| Ex. 8 | Liquid a (50)<br>Liquid f (50) | 11 | Resin A | 1.9 | 37 | 39 | 1.1 | 92 |
| Ex. 9 | Liquid a (20)<br>Liquid g (80) | 35 | Resin A | 2.0 | 101 | 126 | 1.2 | 91 |
| Ex. 10 | Liquid a (50)<br>Liquid g (50) | 18 | Resin A | 1.9 | 57 | 65 | 1.1 | 91 |
| Ex. 11 | Liquid a | 3 | Resin B | 1.9 | 20 | 22 | 1.1 | 91 |
| Ex. 12 | Liquid a | 3 | Resin C | 2.3 | 38 | 43 | 1.1 | 86 |
| Comp. Ex. 1 | Liquid e | 5 | Resin A | 1.9 | 24 | 30 | 1.3 | 73 |
| Comp. Ex. 2 | Liquid a (5)<br>Liquid e (95) | 5 | Resin A | 1.8 | 24 | 28 | 1.2 | 76 |
| Comp. Ex. 3 | Liquid f | 51 | Resin A | 2.5 | 423 | >1000 | >2.4 | 91 |
| Comp. Ex. 4 | Liquid a (5)<br>Liquid f (95) | 46 | Resin A | 2.0 | 142 | 175 | 1.2 | 91 |
| Comp. Ex. 5 | Liquid a (5)<br>Liquid g (95) | 53 | Resin A | 2.1 | 358 | >1000 | >2.8 | 90 |

*The numerical values inside parentheses when two kinds are used show mixing ratio (mass ratio).

As is clear from Table 4, it can be seen that the liquid developers of Examples 1 to 12 have excellent fusing ability and also storage stability, as compared to those of Comparative Examples 1 to 5.

The liquid developer of the present invention can be suitably used in developing latent images formed in, for example, an electrophotographic method, an electrostatic recording method, an electrostatic printing method, or the like.

What is claimed is:

1. A liquid developer comprising toner particles comprising a resin and a pigment, and an insulating liquid, the toner particles being dispersed in the insulating liquid, wherein the insulating liquid comprises an olefin having 12 carbon atoms or more and 18 carbon atoms or less in an amount of 10% by mass or more.

2. The liquid developer according to claim 1, wherein the resin comprises a polyester.

3. The liquid developer according to claim 2, wherein the polyester has an acid value of 3 mgKOH/g or more and 110 mgKOH/g or less.

4. The liquid developer according to claim 2, wherein the content of the polyester is 90% by mass or more of the resin.

5. The liquid developer according to claim 1, wherein the olefin is an internal olefin.

6. The liquid developer according to claim 1, wherein the number of double bonds in one molecule of the olefin is 3 or less.

7. The liquid developer according to claim 1, wherein the content of the olefin is 40% by mass or more of the insulating liquid.

8. The liquid developer according to claim 1, wherein the content of the olefin is 90% by mass or more of the insulating liquid.

9. The liquid developer according to claim 1, wherein the liquid developer is obtained by dispersing the toner particles in an insulating liquid in the presence of a dispersant, and wet-milling the toner particles to provide a liquid developer.

10. The liquid developer according to claim 1, wherein the insulating liquid has a viscosity at 25° C. of 1 mPa·s or more and 55 mPa·s or less.

11. The liquid developer according to claim 1, wherein the insulating liquid has a viscosity at 25° C. of 2 mPa·s or more and 4 mPa·s or less.

12. The liquid developer according to claim 1, wherein the insulating liquid comprises an insulating liquid other than the olefin, wherein the insulating liquid other than the olefin is a vegetable oil.

13. The liquid developer according to claim 12, wherein the vegetable oil is rapeseed oil or safflower oil.

14. The liquid developer according to claim 12, wherein the mass ratio of the olefin to the insulating liquid other than the olefin, i.e. the olefin/the insulating liquid other than the olefin, is from 15/85 to 60/40.

15. The liquid developer according to claim 1, wherein the number of carbon atoms of the olefin is 16 or 18.

16. The liquid developer according to claim 1, wherein the olefin is hexadecene and/or octadecene.

17. The liquid developer according to claim 1, wherein the toner particles in a liquid developer have a volume-median particle size of 0.5 μm or more and 5 μm or less.

18. The liquid developer according to claim 1, wherein the liquid developer has a viscosity at 25° C. of 2 mPa·s or more and 150 mPa·s or less.

19. The liquid developer according to claim 1, wherein the content of the pigment is 5 parts by mass or more and 100 parts by mass or less, based on 100 parts by mass of the resin.

* * * * *

UNITED STATES PATENT AND TRADEMARK OFFICE

CERTIFICATE OF CORRECTION

PATENT NO. : 9,098,004 B2
APPLICATION NO. : 14/135987
DATED : August 4, 2015
INVENTOR(S) : Tatsuya Yamada et al.

It is certified that error appears in the above-identified patent and that said Letters Patent is hereby corrected as shown below:

On the title page, Item (30), the Foreign Application Priority Data Information has been omitted. Item (30) should read:

--(30) Foreign Application Priority Data

Dec. 27, 2012 (JP).....2012-284759--

Signed and Sealed this
Second Day of February, 2016

Michelle K. Lee

Michelle K. Lee
*Director of the United States Patent and Trademark Office*